US006174581B1

(12) United States Patent
Barker

(10) Patent No.: US 6,174,581 B1
(45) Date of Patent: Jan. 16, 2001

(54) TOILET SKIRT

(76) Inventor: Hedy Barker, 2910 NE. County Rd. 219A, Melrose, FL (US) 32666

( * ) Notice: Under 35 U.S.C. 154(b), the term of this patent shall be extended for 0 days.

(21) Appl. No.: 09/382,767

(22) Filed: Aug. 25, 1999

(51) Int. Cl.[7] ..... B32B 3/02; B32B 3/10

(52) U.S. Cl. ..... 428/43; 428/138; 428/181; 4/251.1; 4/661

(58) Field of Search ..... 428/43, 138, 181; 4/251.1, 251.2, 661

(56) References Cited

U.S. PATENT DOCUMENTS

| | | | |
|---|---|---|---|
| 4,125,656 | 11/1978 | Creamer | 428/80 |
| 4,285,075 | 8/1981 | Nelson | 4/252 A |
| 4,328,275 | 5/1982 | Vargo | 428/156 |
| 4,609,580 | 9/1986 | Rockett et al. | 428/198 |
| 5,088,132 | 2/1992 | Walka | 4/300.3 |

*Primary Examiner*—Alexander S. Thomas

(57) ABSTRACT

A toilet skirt for being positioned around a toilet base and absorbing any moisture that collects thereat. The toilet skirt is a body member that has a pair of moisture absorbent layers that sandwich a moisture impervious layer between them. A plurality of pleats are located on the top moisture absorbent layer and a perforation seams passes between a first side of the body member and the pleats. The perforation seam and the pleats allow a portion of the top layer to fit around the sides of the toilet base in turtleneck fashion to collect moisture therefrom.

8 Claims, 2 Drawing Sheets

TOILET SKIRT

BACKGROUND OF THE INVENTION

1. Field of the Invention

The present invention relates to a moisture absorbing pad that is placed around a toilet base.

2. Background of the Prior Art

The area around a toilet base can become quite populated with moisture, especially if a lot of males use the toilet. The problem with moisture accumulation is compounded by condensation that forms on the sides of the toilet and gravitates down to the floor. The accumulated moisture not only creates an unsightly appearance, but is also smelly and unsanitary.

One solution to cure the moisture accumulation problem is to clean the area regularly. But as many housekeepers will admit, such is not a pleasant task.

Another solution is to provide an absorption device around the base to capture any moisture. Moisture accumulation occurs within the device, and once saturated, the device is either washed and reused, or preferably discarded.

Many such devices have been proposed for absorbing moisture around the base of a toilet. The prior art devices work with varying degree of efficiency. However, some of the devices are unduly complex and are therefore expensive to manufacture, while other devices have limited functional capacity, thereby making them effective only in low traffic volume toilets.

Therefore, there is a need in the art for an absorbent pad to be used around the toilet base that overcomes the aforementioned needs in the art. The device must be of relatively simple design and construction and must be able to absorb a relatively large amount of moisture.

SUMMARY OF THE INVENTION

The toilet skirt of the present invention addresses the aforementioned needs in the art. The toilet skirt is of relatively simple and straightforward construction making it relatively inexpensive to manufacture. The toilet skirt is designed to absorb a sufficient amount of moisture for many toilet base moisture accumulation settings.

The toilet skirt is comprised of a body member that has a moisture absorbent top layer, a moisture impervious medial layer, and a moisture absorbent bottom layer. The body member has a generally straight first side, at least one second side, and a medial portion. A plurality of pleats are disposed within the top layer while an opening is located in each of the medial layer and the bottom layer below the plurality of pleats. A perforation seam passes through the body member and extends between the plurality of pleats and the first side. The plurality of pleats radiate outwardly from the perforation seam.

The toilet skirt is positioned such that the base of the toilet is received within the opening created by tearing along the perforation and flipping a portion of the top layer including the pleats upwardly. The flipped up portion encompasses the sides and front of the toilet base. If necessary, the flipped up portion can be taped or otherwise adhered to the toilet. The top layer does the majority of moisture absorption with the medial layer prevents the accumulated moisture from passing to the bottom layer from where it could leak out of the device. The bottom layer absorbs any moisture that makes its way onto the floor proximate the toilet and can be used to wipe up any moisture when the device is removed during replacement.

BRIEF DESCRIPTION OF THE DRAWINGS

Similar reference numerals refer to similar parts throughout the several views of the drawings.

DESCRIPTION OF THE PREFERRED EMBODIMENT

Figure 1:
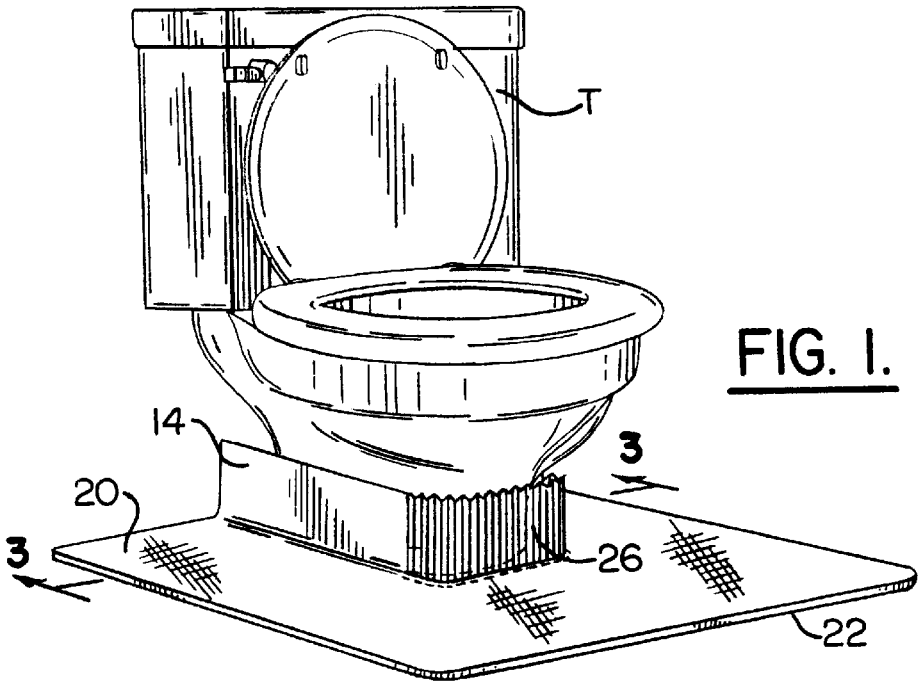
FIG. 1 is an environmental view of the toilet skirt of the present invention in place about a toilet.
Figure 2:
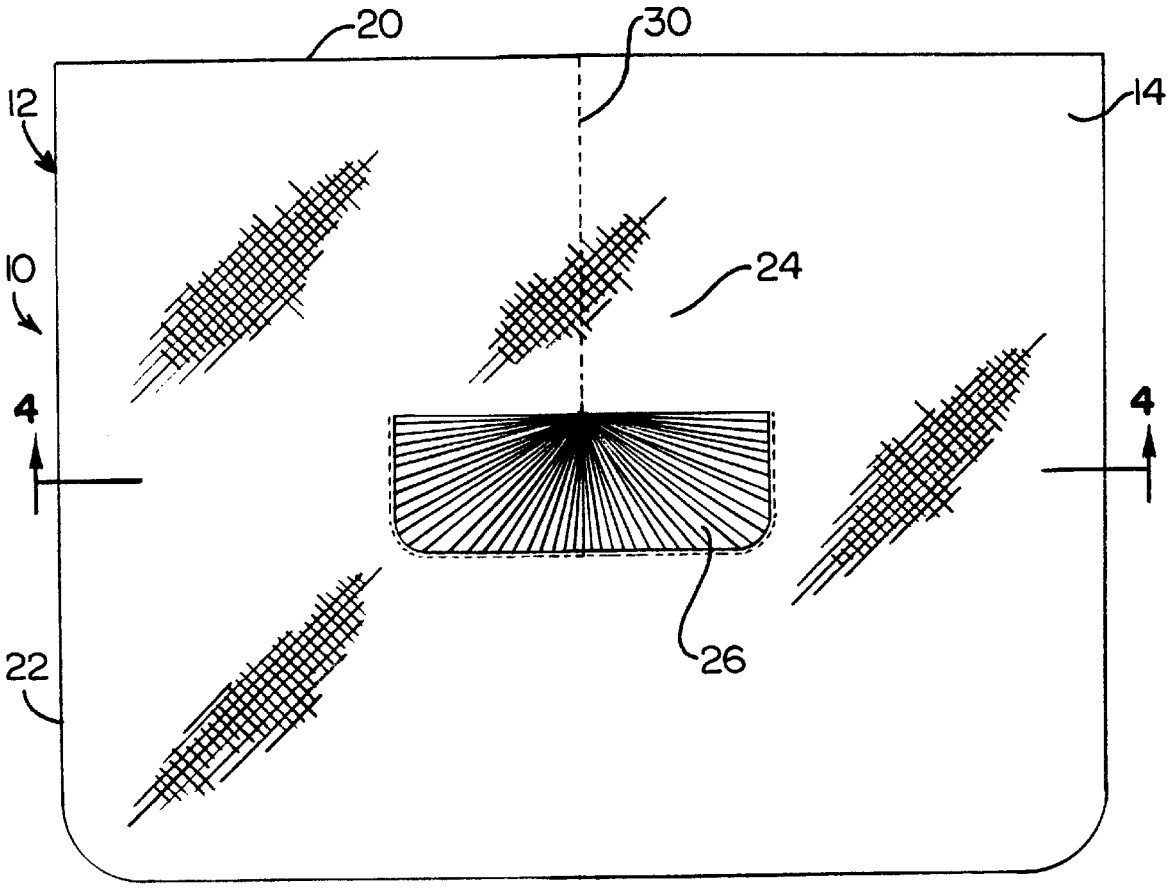
FIG. 2 is a top plan view of the toilet skirt.
Figure 3:
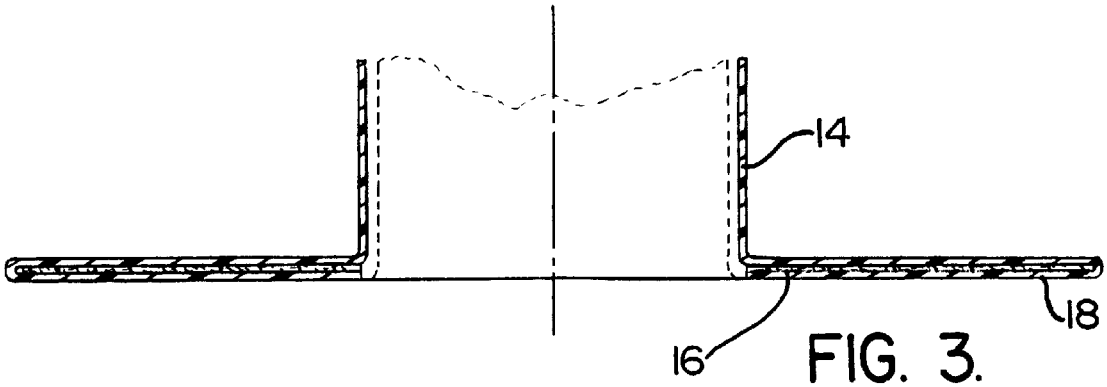
FIG. 3 is a sectioned view taken along line 3—3 in FIG. 1.
Figure 4:
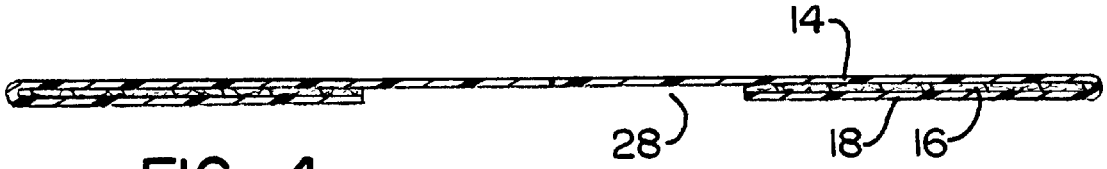
FIG. 4 is a sectioned view taken along line 4—4 in FIG. 2.

Referring now to the drawings, it is seen that the toilet skirt of the present invention, generally denoted by reference numeral 10, is comprised of a body member 12 that has a moisture absorbent top layer 14, a moisture impervious medial layer 16, and a moisture absorbent bottom layer 18. The top layer 14 and the bottom layer 18 can be made from any desirable moisture absorbent material such as cotton, while the medial layer 16 can be made from any moisture impervious material such as plastic, and is preferably flexible for easy packaging, shipping and installing of the device 10. The body member 12 has a first side 20 that is generally straight, at least one second side 22 that can give the body member 12 any desired shape such as the illustrated generally rectangular, as well as triangular, semi-ovular, etc., and a medial portion 24. A plurality of pleats 26 are disposed within the top layer 14 while an opening 28 is located in each of the medial layer 16 and the bottom layer 18 below the plurality of pleats 26. A perforation seam 30 passes through the body member 12 and extends between the plurality of pleats 26 and the first side 20. The plurality of pleats 26 radiate outwardly from the perforation seam 30.

In order to use the toilet skirt of the present invention, the perforation seam 30 is torn along its entire length and the a portion of the top layer 14 including the plurality of pleats 26 are flipped upwardly. The device 10 is positioned such that the first side 20 is either facing or abutting the wall to which the toilet T is secured (depending on the distance from the toilet T to the wall and the length of the toilet skirt 10). In this position, the device 10 is positioned such that is horizontally straddles the toilet T and the flipped up section of the top layer 14 encompasses the sides and the front of the toilet T in turtleneck fashion with the pleats 26 allowing a proper fit. The toilet skirt 10 is now properly positioned. The top layer 14 absorbs any moisture that hits it directly as well as any condensation that forms on the sides of the toilet while the bottom layer absorbs any moisture that finds its way onto the floor around the toilet T. The medial layer 16 prevents moisture from the top layer 14—which will typically perform the larger amount of absorption work—from passing to the bottom layer 18 from where it could be discharged from the device 10 and onto the floor if too much weight is present on the toilet skirt 10.

While the invention has been particularly shown and described with reference to an embodiment thereof, it will be appreciated by those skilled in the art that various changes in form and detail may be made without departing from the spirit and scope of the invention.

I claim:

1. A toilet skirt comprising:

a body member having a moisture absorbent top layer, a moisture absorbent bottom layer, a moisture impervious medial layer disposed between the top layer and the bottom layer, a first side, at least one second side, and a medial portion;

a plurality of pleats disposed within the top layer at the medial portion; and a perforation seam passing through the body member and extending between the first side and the plurality of pleats.

2. The toilet skirt as in claim 1 wherein the medial layer is made from a flexible material.

3. The toilet skirt as in claim 1 wherein the plurality of pleats radiate outwardly from the perforation.

4. The toilet skirt as in claim 1 wherein the first side is generally straight.

5. A toilet skirt comprising:

a body member having a moisture absorbent top layer, a moisture absorbent bottom layer, a moisture impervious medial layer disposed between the top layer and the bottom layer, a first side, at least one second side, and a medial portion, the medial layer having a first opening located at the medial portion and the bottom layer having a second opening that corresponds with the first opening;

a plurality of pleats disposed within the top layer located over top the first opening and the second opening; and a perforation seam passing through the body member and extending between the first side and the plurality of pleats.

6. The toilet skirt as in claim 5 wherein the medial layer is made from a flexible material.

7. The toilet skirt as in claim 5 wherein the plurality of pleats radiate outwardly from the perforation.

8. The toilet skirt as in claim 5 wherein the first side is generally straight.

* * * * *